United States Patent [19]

Hattori et al.

[11] Patent Number: 4,575,733

[45] Date of Patent: Mar. 11, 1986

[54] THERMAL PRINTER

[75] Inventors: Shigenori Hattori, Oharucho; Hideo Ueno, Nagoya; Toyohisa Uchida, Yokkaichi, all of Japan

[73] Assignee: Brother Industries, Ltd., Magoya, Japan

[21] Appl. No.: 673,564

[22] Filed: Nov. 21, 1984

[30] Foreign Application Priority Data

Nov. 25, 1983 [JP] Japan ..... 58-223026

[51] Int. Cl.[4] ..... B41J 19/00

[52] U.S. Cl. ..... 346/76 PH; 400/54; 400/120

[58] Field of Search ..... 400/54, 120, 50; 346/76 R, 162, 76 PH, 139 R; 219/216 PH

[56] References Cited

U.S. PATENT DOCUMENTS 3,509,980 5/1970 Loughry et al. ..... 346/76 PH 4,279,523 7/1981 Ringle ..... 400/54

*Primary Examiner*—E. A. Goldberg
*Assistant Examiner*—A. Evans
*Attorney, Agent, or Firm*—Kane, Dalsimer, Kane, Sullivan & Kurucz

[57] ABSTRACT

A thermal printer including a thermal head automatically moved between an operative position in which it is held in pressing engagement with a printing sheet and an inoperative position in which it is released from pressing engagement with the printing sheet. The thermal printer also includes a capacitor serving as a battery device for storing an electric charge when a power source is turned on and releases the stored electric charge when the power source is turned off, to thereby move the thermal head to the inoperative position in which it is released from pressing engagement with the printing sheet.

8 Claims, 9 Drawing Figures

THERMAL PRINTER

BACKGROUND OF THE INVENTION (1) Field of the Invention

This invention relates to a thermal printer of heat-sensitive type or thermal transfer-printing type.

(2) Description of the Prior Art

Generally, in thermal printers of the prior art, a thermal head has been moved along a line of printed characters while pressing against a printing sheet, and a multiplicity of heat generating elements located in the thermal head have been selectively actuated to generate heat to perform printing. When a printing operation is finished or when it is interrupted, the thermal head has been urged by means of a solenoid or a resilient member to move to a position in which it presses against the printing sheet or a position in which it is released from pressing engagement with the printing sheet. In the thermal printer of the type which uses a resilient member to bring the thermal head into pressing engagement with the printing sheet by its biasing force, a problem has been raised with regard to operability. More specifically, even if a switch is actuated to turn off the power source, the thermal head is still maintained in pressing engagement with the printing sheet, so that a head release level should be actuated to move the thermal head away from the printing sheet when it is desired to remove the printing sheet and set a new printing sheet or to replace the thermal transfer-printing ribbon by a new one. Particularly when the thermal printer is of a thermal transfer-printing type, the thermal transfer-printing ribbon might be pulled excessively when the printing sheet is pulled manually while the power source is an OFF condition, thereby inadvertently damaging the thermal transfer-printing ribbon. When the thermal printer is of a type in which a solenoid is relied on to bring the thermal head into and out of pressing engagement with the printing sheet, it is necessary to maintain the solenoid in an energized condition. This has given rise to the problem that power consumption is high. Particularly when the thermal printer relies on a battery as a source of motive power, the battery used has a short service life.

SUMMARY OF THE INVENTION

This invention has been developed for the purpose of obviating the aforesaid disadvantages of the prior art. Accordingly, the invention has as its object the provision of a thermal printer of high operability capable of moving the thermal had away from the printing sheet by a simple constructional feature when the power source is turned off.

According to the invention, there is provided a thermal printer comprising first holding means for holding a thermal head in an inoperative position in which it is away from a printing sheet when the printing sheet is advanced, second holding means for holding the thermal head in an operative position in which it presses against the printing sheet when a printing operation is performed, and actuating means operative to move the thermal head between the inoperative position and operative position, wherein the improvement comprises a switch for turning on and off a power source, battery means capable of storing an electric charge when the power source is turned on, and a control unit for causing the battery means to render the actuating means operative to move the thermal head from the operative position to the inoperative position when the power switch is turned off.

Additional and other objects, features and advantages of the invention will become apparent from the description set forth hereinafter when considered in conjunction with the accompanying drawings.

DESCRIPTION OF THE PREFERRED EMBODIMENT

A preferred embodiment of the invention will be described by referring to the accompanying drawings.

Figure 1:
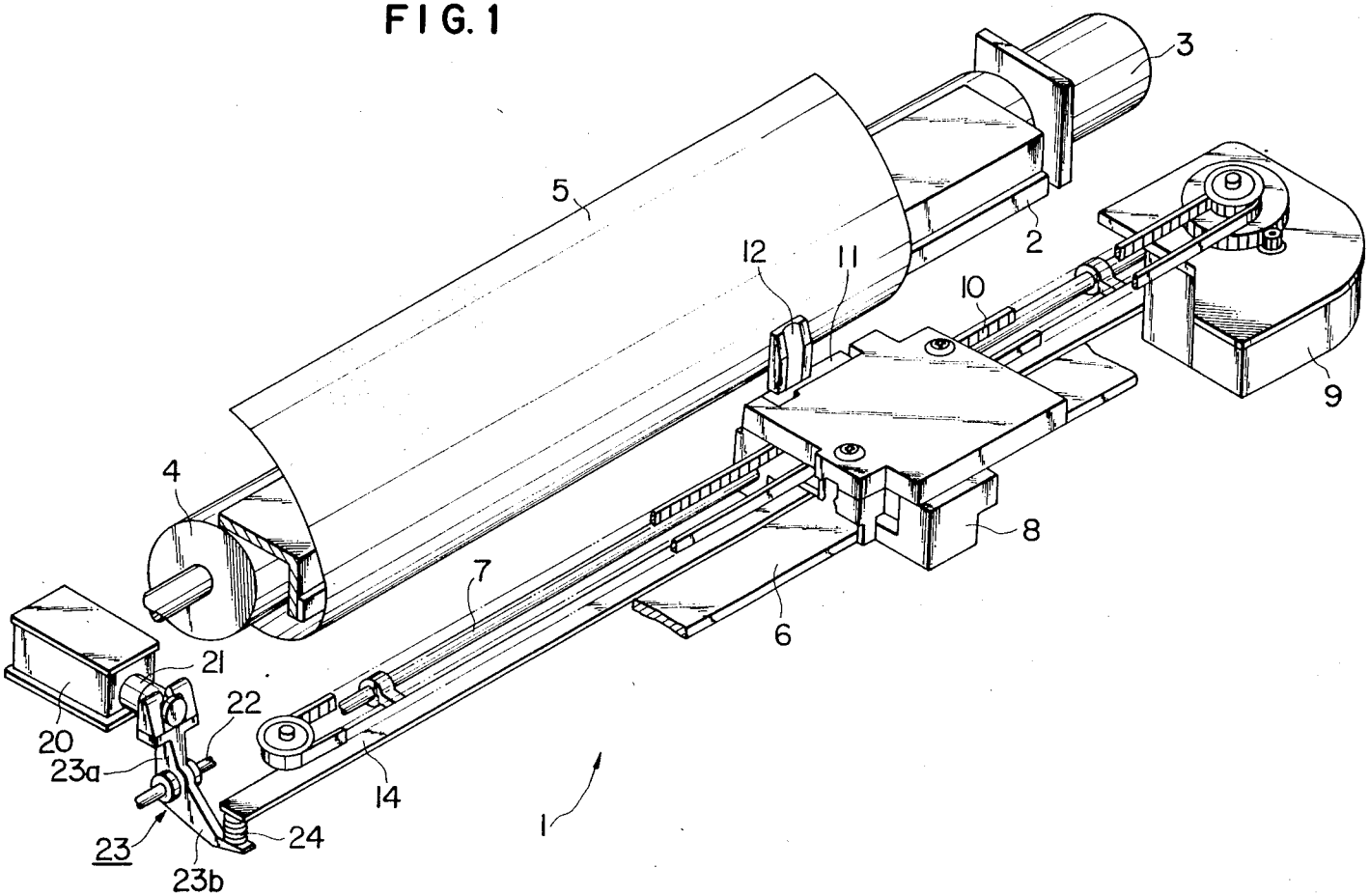
FIG. 1 is a fragmentary perspective view of a thermal printer in which the invention is incorporated.
Figure 2A:
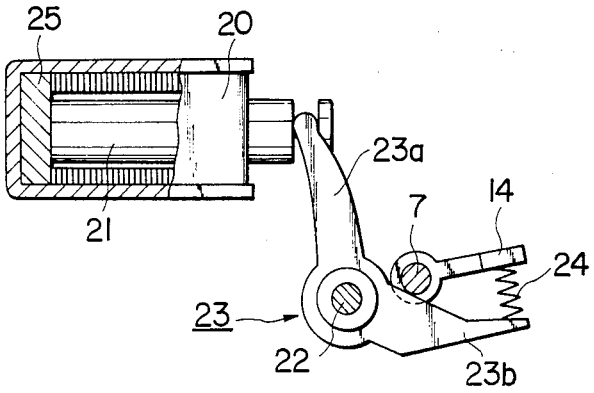
FIG. 2(A) is a view, with certain parts being broken away, in explanation of the actuating means disposed in a position in which it has moved the thermal head to the operative position in which it presses against sheet.
Figure 2B:
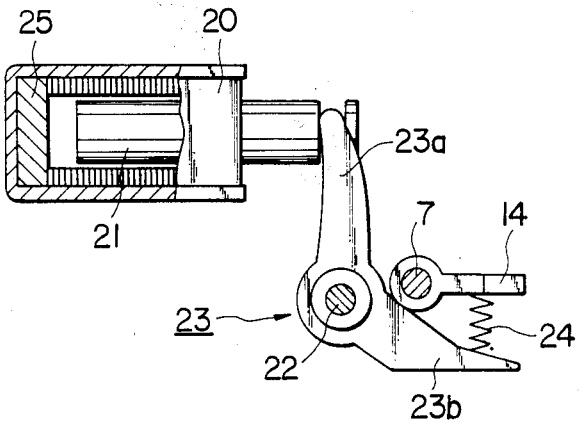
FIG. 2(*b*) is a view, with certain parts being broken away, in explanation of the actuating means disposed in a position in which it has moved the thermal head to the imperative position in which it is released from engagement with the printing sheet.
Figure 3:
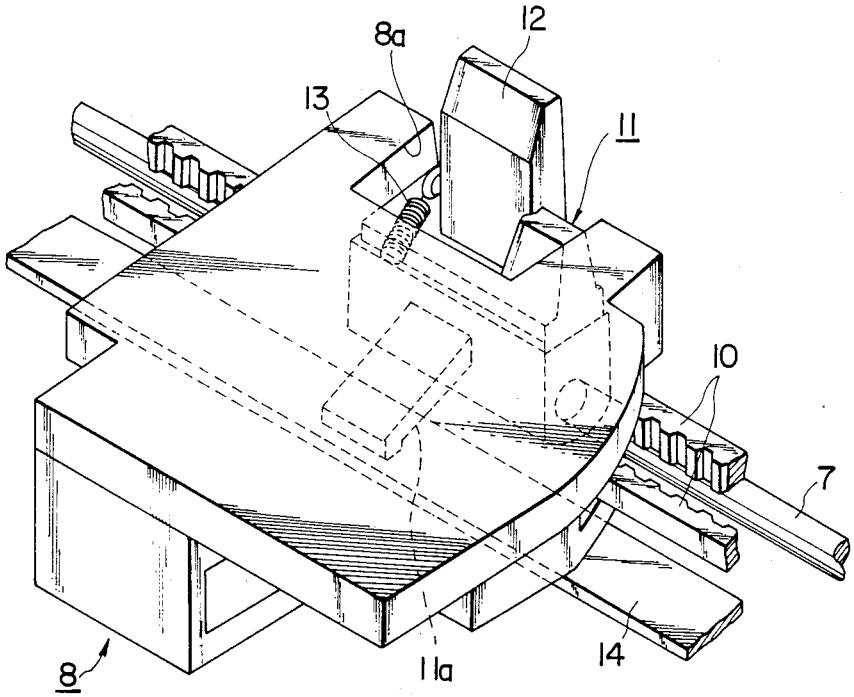
FIG. 3 is a fragmentary perspective view of the thermal printer, showing the carriage.

In FIGS. 1–3, a thermal printer generally designated by the reference numeral 1 includes a platen 2 secured to a frame, not shown, which supports a heat-sensitive sheet 5 mounted thereon as a support drum 4 is rotated by a sheet advancing step-motor 3 drivingly connected thereto. Also secured to the frame are a carriage guide 6 and a guide shaft 7 located parallel to the platen 2. The carriage guide 6 supports a carriage 8 which is driven for reciprocatory movement by a drive belt 10 connected to a step-motor 9 in a direction parallel to the platen 2 while being guided by the carriage support 6. The guide shaft 7 supports a head holder 11 for pivotal movement which is also movable in reciprocatory movement. The head holder 11 which is located in a cutout 8*a* formed in the carriage 8 is movable in reciprocation with the carriage 8 as a unit. The head holder 11 has mounted thereon a thermal head 12 which is provided with a multiplicity of heat generating elements, not shown, arranged in the direction of movement of the heat-sensitive sheet 5, which are selectively caused to generate heat to cause different color developing layers of the heat-sensitive sheet 5 to develop colors to print characters in a dot matrix on the heat-sensitive sheet 5.

Referring to FIG. 3, a tension spring 13 serving as first holding means is mounted between the carriage 8 and head holder 11 to hold by its biasing force the thermal had 12 in an inoperative position in which it is released from pressing engagement with the heat-sensitive sheet 5. Pivotably supported by the guide shaft 7 is a head release plate 14 which is brought into pressing engagement with a level 11*a* of a head holder pivotally moved by the biasing force of the tension spring 13 and held in a position shown in FIG. 2(B), to thereby move the thermal head 12 away from the heat-sensitive sheet 5. A solenoid 20 serving as actuating means is mounted on the frame on a left end of the head release plate 14 as shown in FIG. 1. The solenoid 20 which is of a bifilar winding type is operative to move a plunger 21 to a position shown in FIG. 2(A) or a position shown in FIG. 2(B) by suitably switching a current from one winding to the other. The plunger 21 has connected thereto one arm 23*a* of a pivotable lever 23 movable in pivotal movement about a support shaft 22 and having another arm 23*b* which is connected to the head release plate 14 through a compression spring 24. A permanent magnet 25 serving as second holding means is mounted within the solenoid 20 and operative to magnetically attract the plunger 21 moved to the position shown in FIG. 2(A) to keep the pivotable lever 23 in the illustrated position. This allows the head release plate 14 to move in pivotal movement against the biasing force of the tension spring 13, to thereby maintain the thermal head 12 in an operative position in which it presses against the heat-sensitive sheet 5.

Figure 4:
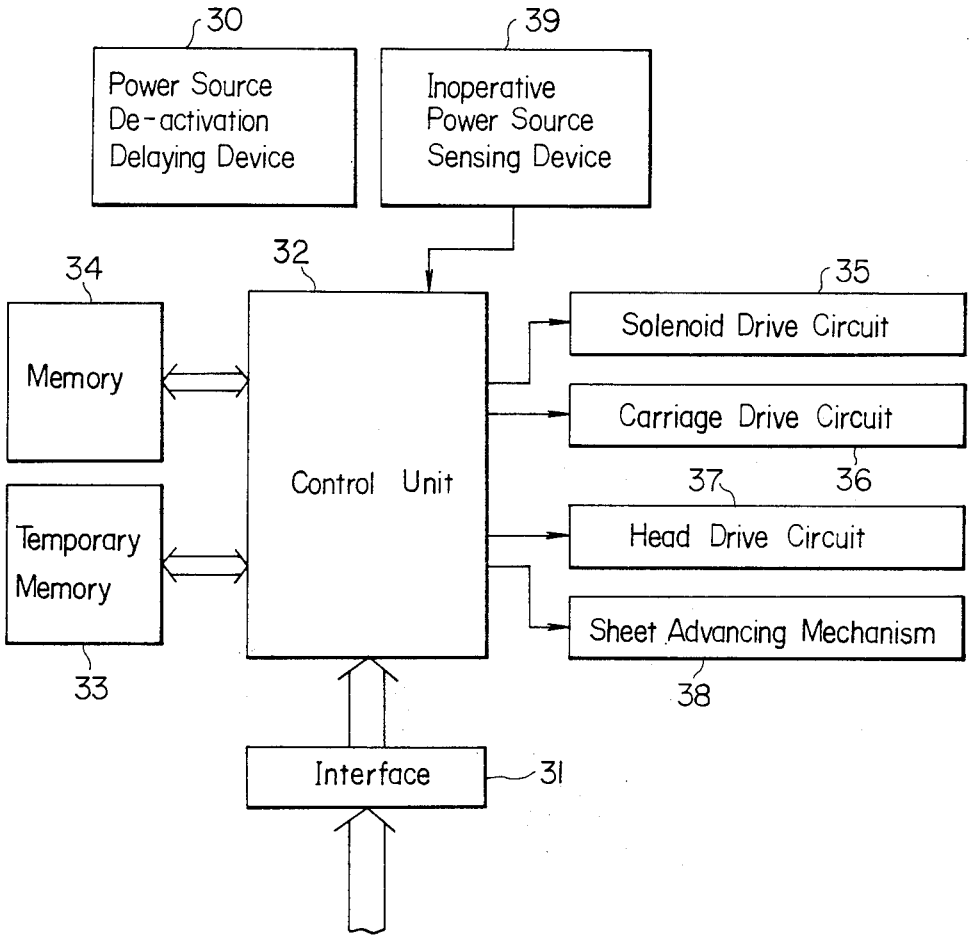
FIG. 4 is an electronic block diagram of the thermal printer.
Figure 5:
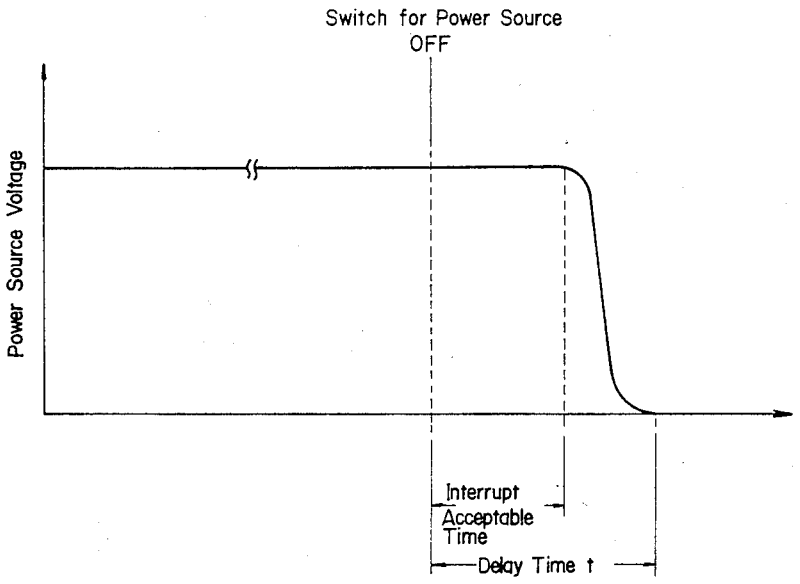
FIG. 5 is a view of the wave form showing fluctuations in the power source voltage.

Referring to FIGS. 4 and 5, when a switch, not shown, for turning on a power source, not shown, is actuated, a power source de-activation delaying device 30 causes a capacitor, not shown, serving as battery means, to store an electric charge by a power source voltage supplied thereto. As printing data are inputted from an external device, not shown, via an interface 31, a control unit 32 writes the printing data to a temporary memory 33 that can be rewritten. As a unit of printing data corresponding to one line of printed characters is written to the temporary memory 33, access is had from the temporary memory 33 to the control unit 32 which read out from a memory 34 a unit of pattern data based on the unit of printing data for printing one line of characters. The memory 34 stores a multiplicity of units of pattern data of each character corresponding to units of printing data.

The control unit 32 outputs a head pressing signal of a predetermined duration to a solenoid drive circuit 35, to energize one winding of the solenoid 20 shown in FIGS. 2(A) and 2(B). This moves the plunger 21 to the position shown in FIG. 2(A), so that the pivotable lever 23 is moved to the position shown in FIG. 2(A) and the plunger 21 is magnetically attracted to the permanent magnet 25. Thus, the head release plate 14 is held in the position shown in FIG. 2(A) in which it presses against the lever 11*a* (FIG. 3) to force the thermal head 12 against the heat-sensitive sheet 5.

After the thermal head 12 is brought into pressing engagement with the heat-sensitive sheet 5 as described hereinabove, a control unit 32 is actuated to output a carriage drive signal to a carriage drive circuit 36 to drive the step-motor 9 for driving the carriage 8 shown in FIG. 1. As the step-motor 9 is actuated, the carriage 8 is moved along a line of characters printed on the heat-sensitive sheet 5. The movement of the carriage 8 causes the control unit 32 to output printing signals corresponding to the pattern data to the head drive circuit 37, to selectively cause the heat generating elements to generate heat. Thus, the thermal head 12 causes the different color developing layers of the heat-sensitive sheet 5 to develop colors to print characters thereon.

After one line of characters has been printed by the above-mentioned operation, the control unit 32 outputs a head release signal of a predetermined duration to the solenoid drive circuit 35, to energize the other winding of the solenoid 20. The magnetic force of the solenoid 20 cancels out the magnetic force of the permanent magnet 25, so that the plunger 21 is moved to the position shown in FIG. 2(B). This allows the pivotable lever 23 to move to the position shown in FIG. 2(B), so that the head release plate 14 is moved to and held in the position shown in FIG. 2(B) by the biasing force of the tension spring 13 acting thereon via the lever 11*a*, and the thermal head 12 is brought out of pressing engagement with the heat-sensitive sheet 5. Thus, the thermal head 12 is held in the inoperative position in which it is away from the heat-sensitive sheet 5.

Following the movement of the thermal head 12 to the inoperative position, the control unit 32 outputs a sheet advancing signal to a sheet feed drive circuit 38 which actuates the sheet advancing step-motor 3 (FIG. 1) to move the support drum 4 in rotary movement a distance corresponding to the width of the line of printed characters, to bring a portion of the heat-sensitive sheet 5 on which a next line of characters is to be printed into face-to-face relation with the thermal head 12. Then, the control unit 32 outputs a head pressing signal to the solenoid drive circuit 35, to bring the thermal head 12 into pressing engagement with the heat-sensitive sheet 5. Thereafter, the thermal head 12 is moved from the previous printing terminating position toward the next printing terminating position to perform printing operations by moving the thermal head 5 in both directions.

As the switch is actuated to turn off the power source after the printing operation is finished or when the printing operation is interrupted, an inoperative power source switch sensing device 39 senses a fall in voltage resulting from the actuation of the switch to turn off the power source and outputs a signal to the control unit 32 which causes the condenser to release the electric charge stored therein when the power source is turned on, to use the released electric charge for controlling and driving purposes. More specifically, the released electric charge provides a predetermined delay time t to the power source in the inoperative condition and causes the control unit 32 to interrupt all the printing actions based on the inoperative power source sensing signal and perform an interrupt with regard to releasing of the thermal head 12 from pressing engagement with the heat-sensitive sheet 5. The control unit 32 outputs a head release signal to the solenoid drive circuit 35 to energize the other winding of the solenoid 20. This releases the plunger 21 from the influence exerted thereon by the permanent magnet 25 (FIGS. 2(A) and 2(B)) in the manner as described previously, and allows the pivotable lever 23 and head release plate 14 to be moved in pivotal movement by the biasing force of the tension spring 13 (FIG. 3). As a result, the thermal head 12 is released from pressing engagement with the heat-sensitive sheet 5 and held in the inoperative position.

Figure 6:
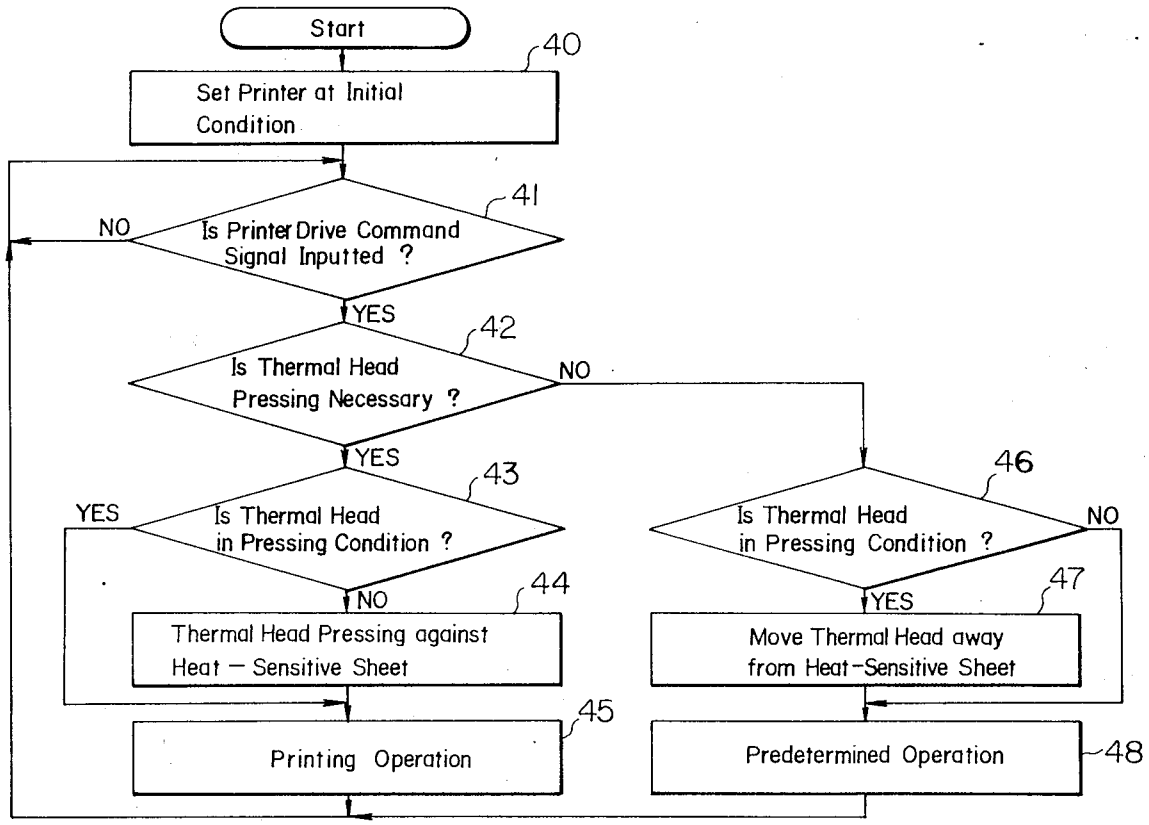
FIG. 6 is a flow chart of the operation for moving the thermal head into and out of pressing engagement with the printing sheet.

The operations of moving the thermal head 12 to the operative position in which is presses against the heat-sensitive sheet 5 and to the inoperative position in which it is released from pressing engagement therewith will be described by referring to FIG. 6.

In step 40, the control unit 32 sets the printer 1 at initial operation condition. In step 41, it is judged whether printing data and printer drive command signals, such as a sheet feeding signal, a line altering signal and a back signal, have been inputted. If the judgment is NO, the operation returns to step 41. If the judgment is YES, the operation shifts to step 42 in which it is judged by the control unit 32 whether the inputted printer drive signals include printing data which make it necessary to bring the thermal head 12 into pressing engagement with the heat-sensitive sheet 5. If the judgment is YES in step 42, the operation shifts to step 43 in which it is judged whether the thermal head 12 is in pressing engagement with the heat-sensitive sheet 5. If the judgment is NO, the operation shifts to step 44 in which the control unit 32 outputs a head pressing signal to the solenoid drive circuit 35 to bring the thermal head 12 into pressing engagement with the heat-sensitive sheet 5. Then, the operation shifts to step 45 in which a printing operation is performed bsaed on the inputted printing data, before the operation returns to step 41. If the judgment is YES in step 43, the operation shifts to step 45 in which a printing operation is performed.

Meanwhile, if the judgment is NO in step 42, it is judged by the control unit 32 in step 46 whether the thermal head 12 is in pressing engagement with the heat-sensitive sheet 5. If the judgment is YES, the control unit 32 outputs a head release signal to the solenoid drive circuit 35 in step 47 to release the thermal head 12 from pressing engagement with the heat-sensitive sheet 5. Then, in step 48, a predetermined operation is performed depending on whether the signal is a sheet feeding signal, a line altering signal or a back signal, before the operation shifts to step 41. If the judgment in step 46 is NO, the operation shifts to step 48.

Figure 7:
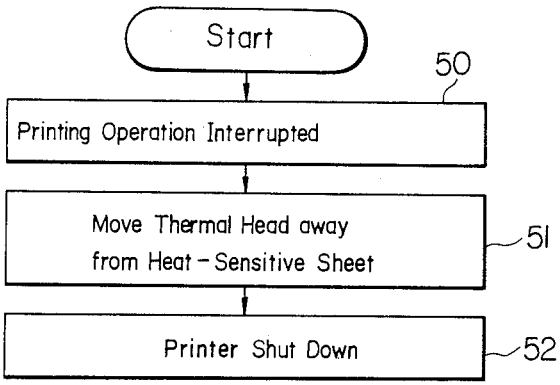
FIG. 7 is a flow chart of an interrupt occurring when the power source is turned off.

An interrupt provided to the operation of turning off the power source will be described by referring to FIG. 7.

When the operation for turning off the power source switch is performed and an inoperative power source sensing signal in inputted from the inoperative power source switch-sensing device 39 to the control unit 32, the operation shifts to step 50 in which the printing operation being performed is interrupted, before the operation shifts to step 51 again, in which a head release signal is outputted to the solenoid drive circuit 35, to release the thermal head 12 from pressing engagement with the heat-sensitive sheet 5 and hold the thermal head 12 in the inoperative position. In step 52, the control unit 32 shuts down the thermal printer 1.

Figure 8:
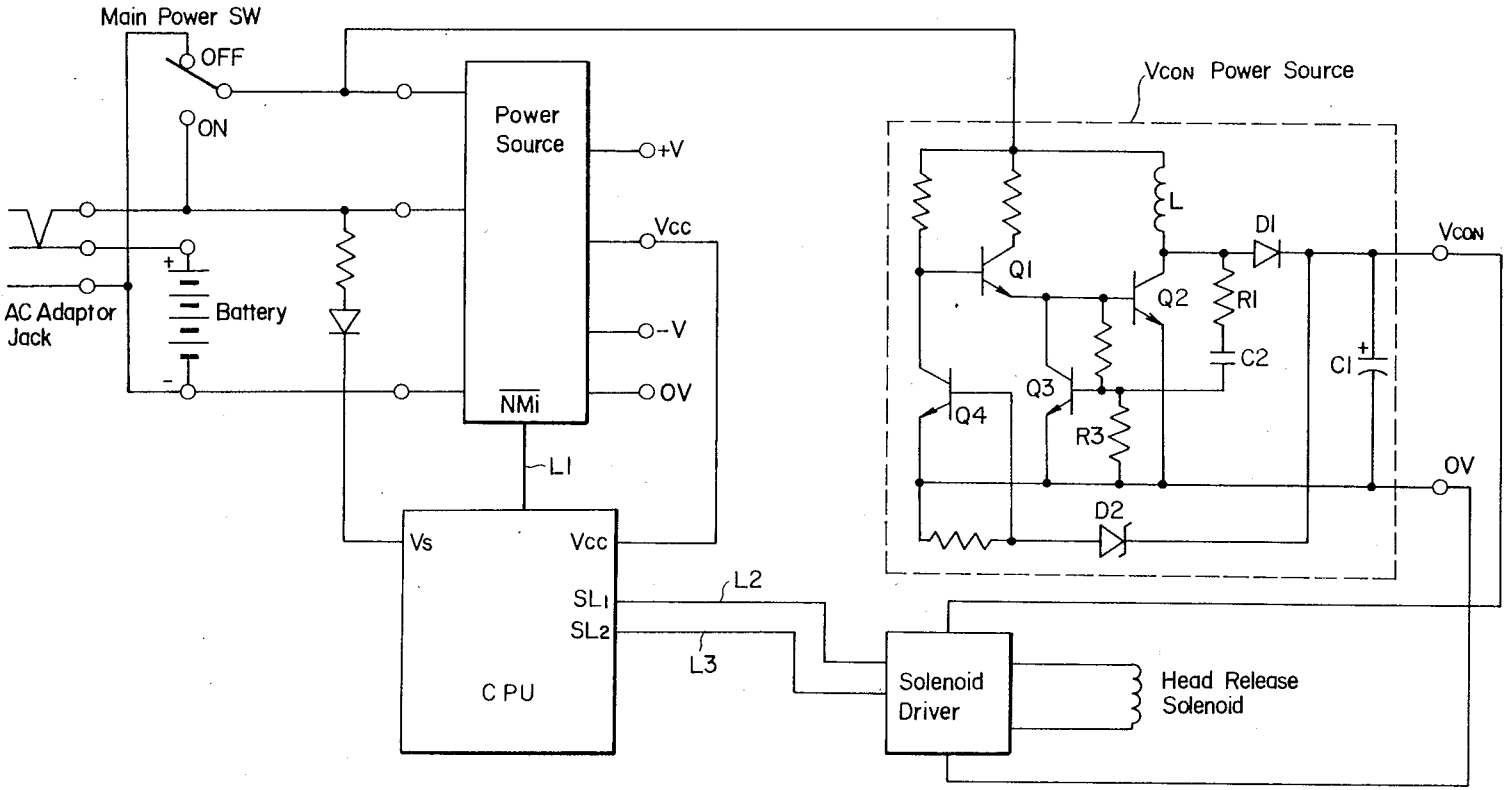
FIG. 8 is a circuit diagram of power source of the thermal printer.

Referring to FIG. 8, the head release device when the main power switch is turned off is actuated as following.

When the movable member of the main power switch is connected to the fixed terminal on the ON side, the current from the AC adapter jack or dry cell battery is supplied to CPU for the power source circuit, Vcon power source circuit or memory backup. The power source circuit is provided with power source terminals for driving heat element of thermal head, carriage drive motor, paper feed motor and the like and a power source terminals for a central circuit for controlling the actions thereof. The power source circuit is connected to CPU through the line $L_1$, and when the main power switch is turned off to thereby stop the action of the power source circuit, a $\overline{NMi}$ signal of high level becomes of low level to enable the detection that the power source turns off. $\overline{NMi}$ signal is an interrupt occurring signal of the highest priority, and when CPU detects this interrupt occurring signal, it interrupts all the other calculations and stores the data and the like to be stored. The Vcon power source circuit is provided with power source terminals for driving head release solenoid and these terminals are connected to the solenoid driver circuit. The Vcon power source circuit is provided with a capacitor $C_1$ of a great capacity which is charged while the main power switch is turned on. The head release solenoid is a bifilar winding and its driver is connected to the CPU by two lines $L_2$ and $L_3$. When an $SL_1$ signal is supplied to $L_2$ from CPU, the head release solenoid is biased to bring the head into pressing engagement with the platen. On the other hand, when $SL_2$ signal is supplied to $L_3$, the above solenoid is biased to release the head from pressing engagement with the platen.

In such a circuit construction as above, when the movable piece of the main power switch it turned to the OFF side of the fixed contact, the power source circuit stops its action and sends to CPU an interrupt occurring signal of low level through the signal line $L_1$.

Upon arrival of the signal $\overline{NMi}$, CPU outputs the head release signal $SL_2$ to the signal line $L_3$, thereby the solenoid driver drives the head release solenoid due to the electric stored charged in the condenser $C_1$ in the Vcon power source circuit to move the head to the inoperative position where the head is released from the platen.

The Vcon power source circuit is a usual oscillating type power source circuit utilizing a counter electromotive force generating in coil $L_1$ when the transistor $Q_2$ is turned on and off. That is, an oscillating circuit is formed by $Q_2$, $Q_3$, $L_1$, $R_1$, $C_2$, $R_2$ and $R_3$. The diode $D_1$ halfwave rectifies the alternating current and the capacitor $C_1$ smoothes the half-wave current. The Zener diode $D_2$ constitutes a feed back circuit for keeping the Vcon terminal voltage constant. When the Vcon terminal voltage increases above a preset value, current flows through the base of $Q_1$ via Zener diode $D_2$ so that $Q_4$ is turned on. Thereby the voltage of the base of $Q_1$ is decreased and $Q_1$, which is normally ON, is turned OFF, so that the action of the above oscillating circuit stops.

At the same time, the Vcon terminal voltage is lowered and then the Diode $D_2$ becomes non-conductive, and $Q_4$ is turned off, while $Q_1$ is turned on so that the oscillating circuit is again actuated.

In the embodiment of the thermal printer is conformity with the invention, the thermal head 12 is automatically released from pressing engagement with the heat-sensitive sheet 5 and held in the inoperative position upon the switch is actuated to turn off the power source. Thus, the heat-sensitive sheet can be mounted on the platen 2 or removed therefrom without requiring the operation of the head release lever by the operator.

While the invention has been described as being incorporated in a thermal printer of the heat-sensitive type in which the heat generating elements of the thermal head 12 are selectively made to generate heat to cause the different color developing layers of the heat-sensitive sheet 5 to develop colors. However, the invention is not limited to this specific form of embodiment, and can be incorporated in a thermal printer of the thermal transfer-printing type in which printing is performed by using a thermal transfer-printing ribbon having a coat of thermo-melt ink which is melted by the heat produced by the heat generating elements of a thermal head by selectively causing same to generate heat to print characters by thermal transfer-printing on a printing sheet.

The thermal printer according to the invention can be realized as a printer of a typewriter type which is connected to a keyboard and one character after another is printed based on data inputted through the keyboard.

From the foregoing description, it will be appreciated that the invention enables the thermal head to be automatically released from pressing engagement with the heat-sensitive sheet and held in an inoperative position by a simple construction when the power source is turned off, thereby improving the operability of the thermal printer.

What is claimed is:

1. A thermal printer comprising:

first holding means for holding a thermal head in an inoperative position in which it is away from a printing sheet when the printing sheet is advanced;

second holding means for holding the thermal head in an operative position in which is presses against the printing sheet when a printing operation is performed; and actuating means operative to move the thermal head between the inoperative position and operative position;

a switch for turning on and off a power source;

battery means capable of storing an electric charge when the power source is turned on; and a control unit for causing the battery means to render the actuating means operative to move the thermal head from the operative position to the inoperative position when the power source is turned off.

2. A thermal printer as claimed in claim 1, in which said first holding means is a tension spring mounting between a carriage and a head holder, so that the thermal head is away from a printing sheet in inoperative condition.

3. A thermal printer as claimed in claims 1 and 2, in which said actuating means is a solenoid mounting on the frame and connecting by plunger to one end of a head release means, so that the thermal head is actuated between the inoperative position and the operative position.

4. A thermal printer as claimed in claim 3, in which said second holder means is a permanent magnet mounted within the solenoid.

5. A thermal printer as claimed in claim 1 wherein the thermal head presses directly against the printing sheet when printing is performed.

6. A thermal printer as claimed in claim 1 further comprising a thermal transfer-ribbon, wherein the thermal head presses against the printing sheet through the transfer-ribbon when printing is performed.

7. A thermal printer as claimed in claim 1 wherein said battery means comprises a capacitor for energizing said actuating means when the power source is turned off.

8. A thermal printer as claimed in claim 7 further comprising an oscillator circuit for generating alternating current and rectifier means for rectifying the alternating current, the rectified current being used to charge said capacitor while said switch is turned on.

* * * * *